US006437304B2

(12) United States Patent
Ushijima et al.

(10) Patent No.: US 6,437,304 B2
(45) Date of Patent: Aug. 20, 2002

(54) STEAM GENERATOR

(75) Inventors: Kazufumi Ushijima, Hirakata; Shinji Makikawa, Takasaki; Tadatomo Ohnoda, Nikko, all of (JP)

(73) Assignees: Sanyo Electric Co., Ltd., Osaka; Shin-Etsu Chemical Co., Ltd.; Shin-Etsu Engineering Co., Ltd., both of Tokyo, all of (JP)

( * ) Notice: Subject to any disclaimer, the term of this patent is extended or adjusted under 35 U.S.C. 154(b) by 0 days.

(21) Appl. No.: 09/789,551

(22) Filed: Feb. 22, 2001

(30) Foreign Application Priority Data

Mar. 15, 2000 (JP) ..... 2000-071493

(51) Int. Cl.[7] ..... H05B 6/80
(52) U.S. Cl. ..... 219/688; 219/710
(58) Field of Search ..... 219/688, 710, 219/682, 687, 702, 686, 690; 34/265, 259, 439

(56) References Cited

U.S. PATENT DOCUMENTS 5,036,172 A * 7/1991 Kokkeler et al. ..... 219/703
5,525,782 A * 6/1996 Yoneno et al. ..... 219/682
5,974,687 A * 11/1999 Gante et al. ..... 34/265
6,008,482 A * 12/1999 Takahashi et al. ..... 219/687
6,040,564 A * 3/2000 Ueda et al. ..... 219/682
6,137,095 A * 10/2000 Kashimoto et al. ..... 219/702
6,218,652 B1 * 4/2001 Kim et al. ..... 219/721

* cited by examiner

*Primary Examiner*—Teresa Walberg
*Assistant Examiner*—Quang Van
(74) *Attorney, Agent, or Firm*—Oliff & Berridge, PLC

(57) ABSTRACT

In a waveguide 11 provided with a magnetron 12, a container 13 made of quartz glass and containing a porous body 14 is placed. The container 13 is connected to a water supply pipe 15, a steam delivery pipe 16 and a drain pipe 17. Pure water regulated at a preset flow rate by a flow control valve 18 drops on the upper face of the porous body 14, and infiltrates into the porous body 14. When the magnetron 12 sends out microwave radiation to the waveguide 11, the pure water contained in the porous body 14 is heated by the microwave, and instantaneously evaporates. The steam of pure water escapes from every surface of the porous body 14 and delivered through the steam delivery pipe 16. An appropriate control of the flow rate of the pure water by the flow control valve 18 and the output power of the magnetron 12 can make an appropriate control of the flow rate of the steam, so that all the pure water supplied to the porous body 14 is converted to steam.

7 Claims, 2 Drawing Sheets

STEAM GENERATOR

The present invention relates to a steam generator which generates steam by heating water, particularly to that suitable for forming a silicon oxide layer by a steam oxidation process.

BACKGROUND OF THE INVENTION

In the process of producing semiconductor integrated circuits, a silicon oxide layer is often formed by oxidizing the silicon substrate itself. Various processes for oxidizing the surface of a silicon substrate have been put into practice. Among them is the steam oxidation process wherein $SiO_2$ is formed by exposing a heated silicon substrate to steam generated by heating pure water reserved in a container. The steam oxidation process is advantageous in its high oxidation speed, and therefore a thick oxide layer can be formed in a relatively short time.

In a conventional steam oxidation process, pure water in a container is heated by a heater placed at the bottom of the container. Therefore, when boiling, the steam bubbles generated through submerge boiling rise and burst at the water surface, which scatters water by small droplets. If the water bumps, such water droplet scattering is more vigorous. Such water droplets are involved in the stream of steam and delivered to the silicon surface. Bumping also causes fluctuation of flow rate of the steam. Such water droplet scattering and flow rate fluctuation are of course harmful to the formation of a silicon oxide layer especially when growing a thick and uniform oxide layer, in which case a stable delivery of steam is required for a long time.

In a general steam generator, some flow control mechanism such as a flow control valve is provided at the outlet of the container to stabilize the flow rate of the steam. The flow control mechanism is not appropriate in the steam oxidation process, however, because impurities may be eluted from the flow control mechanism and enter the water, which seriously deteriorates the quality of the produced silicon substrate. In addition to that, when a flow control valve is used, there must be a pressure difference across the valve, and the pressure in the container must be higher. This requires a high pressure resistance of the container. Further, such high pressure in the container increases the boiling point of the water and enhances elution of the material, or impurities, from the container.

Even if the fluctuation in the flow rate due to bumping is negligible, some measures should be taken to control the flow rate of the steam delivered. Instead of using the above-described flow control mechanism, it is possible to control the electric power to the heater for controlling the flow rate of the steam. This, however, is inadequate because the control response is slow due to the large heat resistance and heat capacity of the container (which is normally made of quartz glass). The response becomes slower as the amount of the water is increased in the container. That is, when water is supplied into the container to make up for the evaporated water, the temperature of the water falls slightly, which largely decreases the evaporating speed (or the steam generating speed). It will take some time to recover the proper steam generating speed.

SUMMARY OF THE INVENTION

The present invention is achieved in view of the above problems. One of the objects of the present invention is, therefore, to provide a steam generator which can generate steam of a stable flow rate without using a steam flow control mechanism. Another object is to provide a steam generator generating a high quality steam which is almost free from impurities or water droplets.

The first steam generator according to the present invention is characterized in that it comprises:

a) means for generating a microwave radiation;

b) a waveguide for the microwave radiation;

c) a structured body placed in the waveguide to absorb water; and d) means for supplying water to the structured body.

The second steam generator according to the present invention is characterized in that, in the above first steam generator, the water is pure water.

The third steam generator according to the present invention is characterized in that, in the above first steam generator, it further includes:

e) means for detecting the temperature of the structured body; and f) means for controlling the microwave generating means to regulate the energy of the microwave radiation sent out to the waveguide according to the temperature detected by the temperature detecting means.

The fourth steam generator according to the present invention is characterized in that, in the above first steam generator, the waveguide is closed at an end and the steam generator further includes:

g) means for detecting the temperature of the microwave generating means; and h) means for controlling the microwave generating means to regulate the energy of the microwave irradiation sent out to the waveguide according to the temperature detected by the temperature detecting means.

The fifth steam generator according to the present invention is characterized in that, in the above first steam generator, the structured body is a solid body including a large number of micro-pores connected to each other.

The sixth steam generator according to the present invention is characterized in that, in the above first steam generator, the structured body is placed in a container having a water inlet and a steam outlet at the upper part and a water drain at the lower part. The water inlet, steam outlet and water drain are connected to respectively appropriate pipes outside of the waveguide.

The seventh steam generator according to the present invention is characterized in that, in the above sixth steam generator, the container is made of quartz.

In the first steam generator according to the present invention, the microwave generating means sends out microwave radiation into the waveguide, while a water supplying means supplies water to the structured body. The water quickly infiltrates into the structured body and is retained there. The water is heated by the microwave radiation coming to the structured body. The water temperature rises in a short time, and the water evaporates and the volume increases. The steam generated in the structured body passes through the micro-pores connected to each other and is emitted from every surface of the structured body. When steam contacts cool water in passing through the micro-pores, the steam is deprived of its latent heat and is condensed to water. Thus the entire absorbing body is heated uniformly, which enables a homogeneous steam generation from the whole structured body.

In the first steam generator, all the water supplied to the structured body can be converted to steam by appropriately determining the flow rate of the water supplied to the structured body and the energy of the microwave irradiation sent out to the waveguide. This means that the flow rate of steam delivered corresponds to the flow rate of water supplied, and it is possible to control the flow rate of steam by controlling the flow rate of the water. The flow rate of water can be controlled by, for example, a flow control valve. If the water supplying means is realized by a water pump, it is possible to control the water pump to control the flow rate of the water.

According to the first steam generator, it is not necessary to provide a flow controller at the outlet of the steam generator in order to control the flow rate of the steam. It is necessary, though, to provide some flow control mechanism, such as a flow control valve, at the water inlet of the steam generator. But the temperature of the water entering the steam generator is very low compared to that of the steam, so that impurities hardly elute from the flow control valve.

In the first steam generator, further, the water is not heated by the structured body, but is heated directly by the microwave radiation, so that very few impurities elute from the structured body. Thus, as in the second steam generator according to the present invention, by supplying pure water free from impurities to the structured body, very clean steam free from impurities can be generated. Further, by controlling the flow rate of the water supply, the flow rate of the delivered steam can be stabilized. Response time in controlling the flow rate of steam is very short because the water evaporates momentarily when supplied to the structured body. Besides, the generated steam is very homogeneous since no bumping occurs and there is no water droplet scattering.

In the first or second steam generator, the temperature rise of the structured body is small as long as water is supplied to it because the microwave radiation is used to heat the water, and the water deprives the structured body of the latent heat of vaporization. If, however, water is not supplied to the structured body, the structured body itself absorbs the microwave radiation and the temperature rises. Further it is a waste of energy to generate microwave radiation when there is no water in the structured body.

In the third steam generator according to the present invention, when the temperature detected by the temperature detecting means is above a preset value, the controller controls the microwave generating means to reduce energy intensity of the microwave radiation. This prevents overheating of the structured body and save the power consumption when water is not supplied. Various devices are available for the temperature detecting means. Among them, a non-contact type temperature sensor is preferable. For example, an infrared temperature sensor is useful, which detects an infrared radiation emitted from the heated structured body.

If an end of the waveguide is closed and no water is supplied to the structured body, the microwave radiation which is not absorbed by the structured body is reflected by the end and return to the microwave generating means. This may cause overheating of the microwave generating means and may lead to its failure.

In the fourth steam generator according to the present invention, similar to the above-described third steam generator, when the temperature detected by the temperature detecting means is above a preset value, the controller controls the microwave generating means to reduce energy intensity of the microwave radiation. This prevents overheating of the structured body or the microwave generating means, and suppress the power consumption when water is not supplied.

In the fifth steam generator according to the present invention, supplied water quickly infiltrates into the structured body owing to the capillary action. The structured body can be made of quartz glass or synthetic resin such as plastics including a large number of micro-pores connected to each other, sponge, etc. Smaller void ratio of the structured body leads to smaller amount of water absorbed and smaller flow rate of steam delivered. Thus the void ratio is preferably about 20 to 80%.

Micro-pores should preferably be distributed evenly. If the micro-pores are distributed unevenly, water absorbed in a concentrated area is last to be evaporated and steam is generated non-uniformly from the structured body, which deteriorates the steam generating efficiency.

It is undesirable for the supplied water to spill into the waveguide. It is also undesirable for the generated steam to travel through the waveguide and reach the microwave generating means. In the sixth steam generator, water is supplied to the container from the water inlet and is absorbed by the structured body. The steam generated in the structured body is discharged from the steam outlet of the container. When water is supplied to the structured body more than it can absorb, the water spill into the container, and is drained from the drain port. Thus, in the sixth steam generator, there is no fear of spilling out of water or steam in the waveguide.

If the container itself is heated by the microwave radiation, the heating efficiency of water lowers. In the seventh steam generator, the container is made of quartz which has a low dielectric constant and low dielectric dissipation factor (loss angle), so that it is hardly heated by the microwave radiation. Therefore, the energy for the water absorbed in the structured body is not wasted, and the water is effectively evaporated.

DETAILED DESCRIPTION OF PREFERRED EMBODIMENTS

Figure 1:
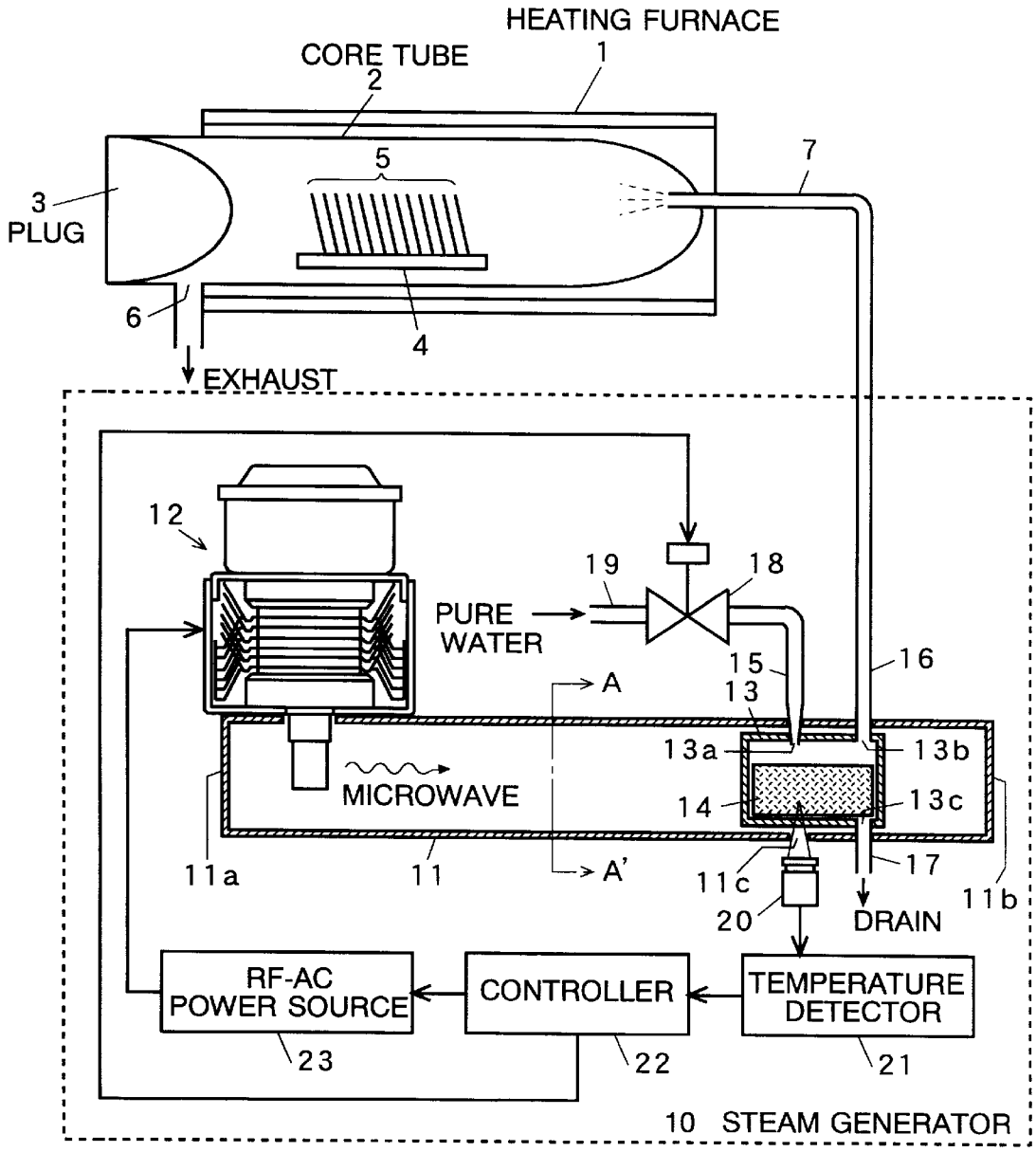
FIG. 1 is a steam generator embodying the present invention used in a silicon oxidizing apparatus.
Figure 2:
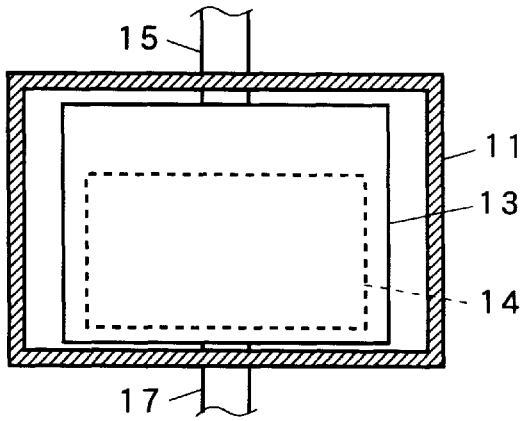
FIG. 2 is a sectional view on line A–A' of FIG. 1.

An embodiment of the steam generator according to the present invention is now described referring to FIGS. 1 and 2. FIG. 1 shows an example of an apparatus for oxidizing silicon surfaces with the steam generator 10 according to the present embodiment. FIG. 2 is a sectional view on line A–A' of FIG. 1.

In FIG. 1, a heating furnace 1 includes a tube with a kanthal heater, in which a core tube 2 made of silicon carbide is inserted. In the core tube 2 is placed a sample tray 4, and the mouth of the core tube 2 is closed by a plug 3 also made of silicon carbide. Several pieces of silicon substrate 5 can be arrayed substantially in parallel to each other on the sample tray 4. In the lower part of the core tube 2 is provided a pressure relief opening 6. A steam generator 10 is connected to the inside of the core tube 2 by a steam delivery pipe 7.

In the steam generator 10, a metallic waveguide 11 is provided. The waveguide 11 has a rectangular cross-section whose width is larger than the height, and the ends are closed by the end walls 11*a* and 11 *b*. Near an end wall 11*a* of the waveguide 11 is placed a magnetron 12 for generating a microwave radiation, with its antenna directed toward the inside of the waveguide 11. Near the other end wall 11*b* with a preset distance is placed a container 13 containing a porous body 14.

The container 13 has a water inlet 13*a* connected to a water supply pipe 15 and a steam outlet 13*b* connected to a steam delivery pipe 16 on its upper wall, and a drain port 13*c* connected to a drain water pipe 17 at its bottom. It is preferable that the container 13 is made of such material that is hardly heated by microwave (e.g. glass or quartz glass).

The steam delivery pipe 16 is connected to the steam delivery pipe 7 of the core tube 2. The water supply pipe 15 is connected to a pure water supply pipe 19 via a flow control valve 18. When the flow control valve 18 is opened, pure water is supplied through the pure water supply pipe 19 and the water supply pipe 15 into the container 13 from the water inlet 13*a*.

The porous body 14 is a solid body having a large number of micro-pores connected with each other. Pure water infiltrates into the porous body 14 through the micro-pores, so that the pure water is absorbed and retained in the porous body 14. The porous body 14 may be made of various materials: porous quarts glass or porous synthetic resin (such as plastics), synthetic resin sponge, etc.

The maximum flow rate of steam depends on the void ratio, which is the volume ratio of the micro-pores to the whole body 14. It is preferable to set the void ratio to be about 20 to 80% to obtain an adequate flow rate of steam. In the present embodiment, the porous body 14 is made of quartz glass, and the void ratio is about 30%.

A hole 11*c* is formed in the bottom wall of the waveguide 11 under the container 13, and an infrared sensor 20 is placed outside of the hole 11*c*. The output of the infrared sensor 20 is sent to a temperature detector 21, where the temperature is detected, and the signal from the temperature detector 21 is sent to a controller 22. The controller 22 can be made of, for example, a microcomputer and other peripheral devices. The controller 22 controls a high voltage power supply 23, which feeds electric power to the magnetron 12, and the above-described flow control valve 18 according to preset control programs.

The operation of the steam generator 10 when it is used to oxidize the surface of silicon substrates is as follows. The operator puts the silicon substrates 5 on the sample tray 4, and places the sample tray 4 in the core tube 2. When an operation starting command is given through an operation panel, or other input devices (not shown in the drawings), a power source (also not shown) feeds electric power to the kanthal heater of the furnace 1, so that the furnace 1 is heated to a preset temperature.

In the steam generator 10, the controller 22 opens the flow control valve 18 to an appropriate value to let the pure water flow to the water pipe at a preset flow rate. The flow rate is preferably such that the pure water from the feed water port 13*a* falls onto the porous body 14 by the drops. Since the drops of pure water quickly infiltrate into the porous body 14, the water does not overflow in the container 13 by properly adjusting its flow rate, as described later.

The controller 22 controls the high voltage power supply 23 to start supplying electric current to the magnetron 12. The magnetron 12 oscillates at a preset frequency (e.g., 2.45 GHz), and microwave radiation is sent out into the waveguide 11. The microwave travels through the waveguide 11, passes the wall, and enters the container 13. In the container 13, the pure water retained in the porous body 14 absorbs the energy of the microwave and evaporates in a very short time. When evaporates, pure water instantaneously expands in its volume and escapes the porous body 14 through the micro-pores.

If the micro-pores are unevenly distributed in the porous body 14, the pure water is also distributed unevenly in the porous body 14. In this case, microwave heating is effected unevenly, so that the efficiency of the steam generation is low. It is desirable, therefore, for the micro-pores to be distributed uniformly in the porous body 14.

Through the above-described microwave heating process, a large amount of steam is generated at every surface of the porous body 14 and is delivered to the core tube 2 through the steam delivery port 13*b* and the steam delivery pipes 16 and 7. Since, in the core tube 2, the silicon substrates 5 are being heated, the surface of the substrates 5 reacts with the steam so that a $SiO_2$ layer is formed on the surface. In the above process, very few or no impurities come into the water and the steam is free from any contaminant or impurities. Thus the $SiO_2$ layer formed with the steam has an excellent quality with very few defects.

In the steam generator 10 of the present embodiment, all the water entering the container 13 is completely evaporated and is delivered into the core tube 2 by adequately controlling the flow rate of the pure water with the flow control valve 18 and the electric current to the magnetron 12. Therefore, the drain pipe 17 is not necessary if such an operation is normally performed. The drain pipe 17 is provided, however, for such abnormal cases as when some error causes an excessive supply of water to the container 13 or for the maintenance of the container where the inside of the container 13 and the porous body 14 are to be washed.

If the amount of water entering the container 13 decreases or if the water flow stops due to a trouble in the flow control valve 18 or by some other causes, microwave radiation may be continuously provided to the porous body 14 with less or no content of the pure water. Even if the porous body 14 is made of such a material having low sensitivity to microwave heating, it can be a load to the microwave without water and is heated by the microwave radiation. The porous body 14 may be damaged if the temperature rises excessively. When the porous body 14 does not contain water, microwave is not absorbed by the porous body 14 and is reflected by the end surface 11*b* of the waveguide 11. In this case the microwave returns to the magnetron 12, and then heats the magnetron 12 itself. Even if such undesirable heating of the porous body 14 or the magnetron 12 are prevented, useless generation of microwave radiation should be avoided in view of energy preservation.

The infrared sensor 20 and the temperature detector 21 are provided to prevent such troubles. When water is contained in the porous body 14, the temperature of the porous body 14 does not rise so much. When, however, the water is exhausted or insufficiently supplied, the temperature of the porous body 14 rises significantly. As the temperature rises, the amount of the infrared radiation emitted from the porous body 14 increases, and the temperature detector 21 detects the abnormal rise of the temperature of the porous body 14 according to the signal from the infrared sensor 20.

When the detected temperature is above a predetermined value, the controller 22, assuming that water is not properly supplied to the porous body 14, controls the high voltage power supply 23 to decrease or stop the driving current to the magnetron 12. Then the energy of the microwave radiation is decreased or the oscillation of the magnetron 12 is stopped, so that the abnormal temperature rise of the porous body 14 or the heating of the magnetron 12 itself can be prevented.

Figure 3:
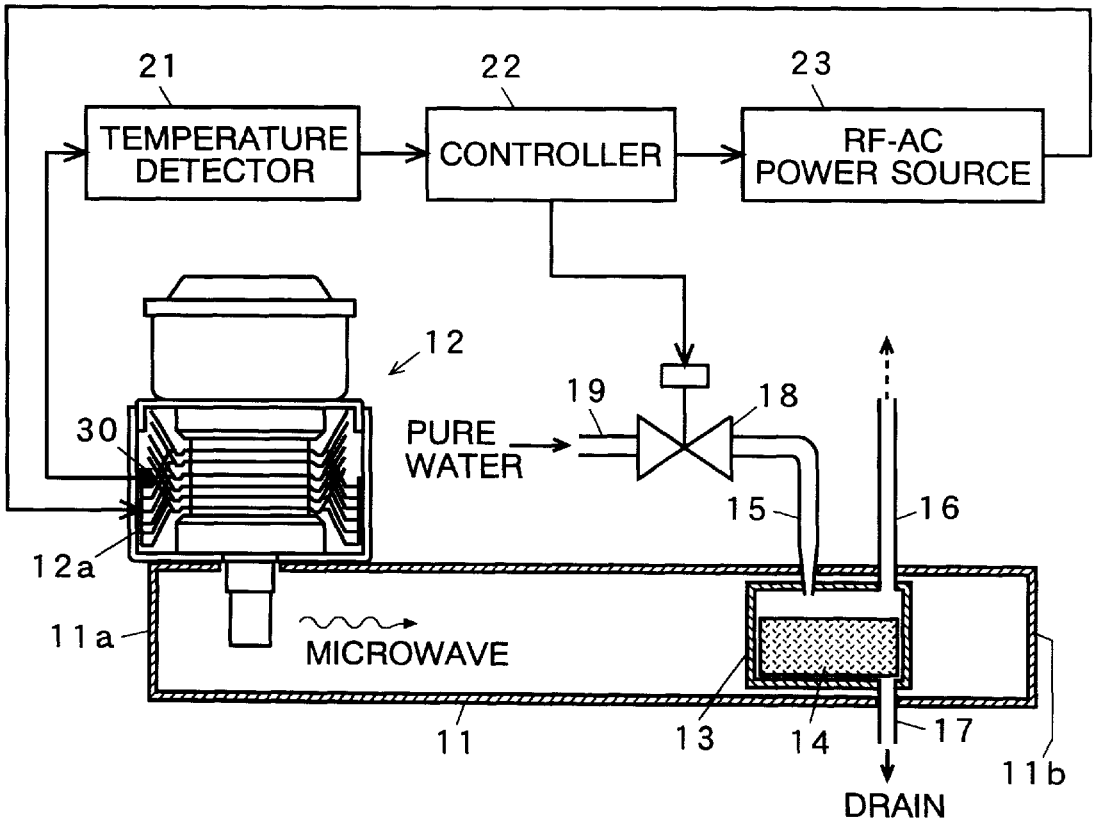
FIG. 3 shows another embodiment of the steam generator according to the present invention.

A second type of steam generator using another way of detecting whether water is retained in the container 13 is described referring to FIG. 3. When, as described above, there is less or no water in the porous body 14, some part of the microwave radiation is reflected and returns to the magnetron 12, in which case the temperature of the magnetron 12 rises. In the steam generator of the present embodiment, a temperature sensor 30 is attached to a radiating fin 12*a* at the cathode of the magnetron 12. The temperature sensor 30 detects the temperature of the magnetron 12, and, if the detected temperature exceeds a predetermined value, the high voltage power supply 23 is controlled, assuming that water is not adequately supplied to the container 13. The present embodiment can also have the same effect as the above embodiment.

The above embodiments are described for better understanding of the invention, so that persons skilled in the art can easily practice various variations within the scope of the present invention.

What is claimed is:

1. A steam generator, comprising:

a) means for generating a microwave radiation;

b) a waveguide for the microwave radiation;

c) a structured body placed in the waveguide for structurally absorbing and retaining liquid water; and d) means for supplying liquid water to the structured body.

2. The steam generator according to claim 1, wherein the water is pure water.

3. The steam generator according to claim 1, wherein the steam generator further comprises:

e) means for detecting a temperature of the structured body; and f) means for controlling the microwave generating means to regulate an energy of the microwave radiation sent out to the waveguide responsive to the temperature detected by the temperature detecting means.

4. The steam generator according to claim 1, wherein the waveguide is closed at an end and the steam generator further comprises:

g) means for detecting a temperature of the microwave generating means; and h) means for controlling the microwave generating means to regulate an energy of the microwave radiation sent out to the waveguide according to the temperature detected by the temperature detecting means.

5. The steam generator according to claim 1, wherein the structured body is a solid body including a large number of micro-pores connected to each other.

6. The steam generator according to claim 1, wherein the structured body is placed in a container having a water inlet and a steam outlet at its upper part and a drain port at its lower part, the water inlet, the steam outlet and the drain port being connected to respective pipes outside of the waveguide.

7. The steam generator according to claim 6, wherein the container is made of quartz.

* * * * *